US010470623B2

(12) United States Patent
Park et al.

(10) Patent No.: US 10,470,623 B2
(45) Date of Patent: Nov. 12, 2019

(54) DRYER AND METHOD FOR CONTROLLING THE SAME

(71) Applicant: LG ELECTRONICS INC., Seoul (KR)

(72) Inventors: Daeyun Park, Seoul (KR); Jong Seok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 184 days.

(21) Appl. No.: 15/680,306

(22) Filed: Aug. 18, 2017

(65) Prior Publication Data

US 2018/0055294 A1 Mar. 1, 2018

(30) Foreign Application Priority Data

Aug. 25, 2016 (KR) ..... 10-2016-0108240

(51) Int. Cl.
*A47K 10/48* (2006.01)
*F26B 23/04* (2006.01)
(Continued)

(52) U.S. Cl.
CPC ..... *A47K 10/48* (2013.01); *F24F 3/153* (2013.01); *F24F 11/65* (2018.01); *F26B 9/003* (2013.01);
(Continued)

(58) Field of Classification Search
CPC ..... F26B 23/04; F26B 23/06; F26B 9/003; A45D 20/04; A45D 20/08; A45D 20/10; A45D 20/12; A47K 10/48
See application file for complete search history.

(56) References Cited

U.S. PATENT DOCUMENTS 4,323,761 A * 4/1982 Hubner ..... A45D 20/10 338/237
5,325,809 A * 7/1994 Mulle, Jr. ..... A45D 20/12 116/112
(Continued)

FOREIGN PATENT DOCUMENTS

CN 103671169 3/2014
CN 104204683 12/2014
(Continued)

OTHER PUBLICATIONS

Chinese Office Action dated Jul. 3, 2019 issued in Application No. 201710710712.6 (English translation attached).

*Primary Examiner* — David J Laux
(74) *Attorney, Agent, or Firm* — Ked & Associates, LLP

(57) ABSTRACT

The present disclosure relates a dyer that includes a front case including a first opening surrounded by an air guide that protrudes forward and a plurality of exhaust holes formed around the first opening, a rear case coupled to the front case and including a second opening surrounded by a housing guide protrudes backward, the second opening overlapping the first opening, a fan housing that is coupled to the first and second openings, is moveable in forward and backward directions along the air guide and the housing guide, and includes a blast fan therein, and a heater that is formed on the fan housing and heats and ejects wind generated by the blast fan, and a direction of the wind ejected from the heater is changed depending on forward and backward movement of the fan housing.

17 Claims, 12 Drawing Sheets

(51) Int. Cl.

| | |
|---|---|
| ***F26B 9/00*** | (2006.01) |
| ***F24F 3/153*** | (2006.01) |
| ***F24F 11/65*** | (2018.01) |
| ***F24F 3/16*** | (2006.01) |
| ***F24F 11/56*** | (2018.01) |
| ***F24F 11/79*** | (2018.01) |
| ***F24F 11/74*** | (2018.01) |

(52) U.S. Cl.
CPC ..... *F26B 23/04* (2013.01); *F24F 11/56* (2018.01); *F24F 11/74* (2018.01); *F24F 11/79* (2018.01); *F24F 2003/1682* (2013.01)

(56) References Cited

U.S. PATENT DOCUMENTS

| | | | | |
|---|---|---|---|---|
| 5,671,547 | A * | 9/1997 | Truchet | A45D 20/124 34/96 |
| 6,671,460 | B1 * | 12/2003 | Smal | A45D 20/12 200/18 |
| 2004/0047620 | A1 * | 3/2004 | Ruben | A45D 20/122 392/385 |
| 2014/0090266 | A1 * | 4/2014 | Rodrigues | A45D 20/12 34/97 |
| 2018/0125195 | A1 * | 5/2018 | Soresina | A45D 20/12 |

FOREIGN PATENT DOCUMENTS

| | | |
|---|---|---|
| CN | 205094319 | 3/2016 |
| CN | 105849469 | 8/2016 |
| JP | H0687325 | 3/1994 |

* cited by examiner

-PRIOR ART-

-PRIOR ART-

DRYER AND METHOD FOR CONTROLLING THE SAME

CROSS-REFERENCE TO RELATED APPLICATION(S)

This application claims the priority of Korean Patent Application No. 10-2016-0108240 filed in Korea on Aug. 25, 2016, in the Korean Intellectual Property Office, the disclosure of which is hereby incorporated by reference in its entirety.

BACKGROUND

1. Field

The present disclosure relates to a dryer and a method for controlling the same, and more particularly, to a dryer and a method for controlling the same for drying a bathroom space or a user body.

2. Background

A dryer is a device that is installed on a wall or other surface of a region, such as a bathroom and provides a flow or warm air to dry the space or a user in the space. In one example shown in FIG. 1, a dryer 10 may include a rotatable direction wings (or vanes) 15*a* and 15*b* (collectively referred to as direction vanes 15) that are installed at an outlet 13 of the dryer to direct a flow of warm air generated by a fan and outputted at the outlet 13. In another example shown in FIG. 2, a dryer 20 includes a rotatable outlet 23 that may be turned, for example, up or down to change a direction of an outputted flow of warm air.

The direction vanes 15 or the rotatable outlet 23 may be difficult for a user to operate, and in particular, it may be difficult for a user to precisely control a volume and/or a direction of the outputted warm air using the direction vane 15 or the rotatable outlet 23. Accordingly, the designs of the dryer 10 and 20 may cause excess amounts of warm air to be outputted in certain directions while the flow of warm air may is at least partially blocked in other directions.

Furthermore, the direction vanes 15*a* and 15*b* or the rotatable outlet 23 may transmit the warm air flow with non-uniform air flow pressures. For example, as previously described, the direction vanes 15*a* and 15*b* or the rotatable outlet 23 may partially block a portion of the outputted warm arm flow. This resistance with respect to the warm air flow generated by the dryer may affect the air flow pressure and cause excessive noise to be generated by the dryer.

BRIEF DESCRIPTION OF THE DRAWINGS

The embodiments will be described in detail with reference to the following drawings in which like reference numerals refer to like elements wherein.

DETAILED DESCRIPTION

Figure 1:
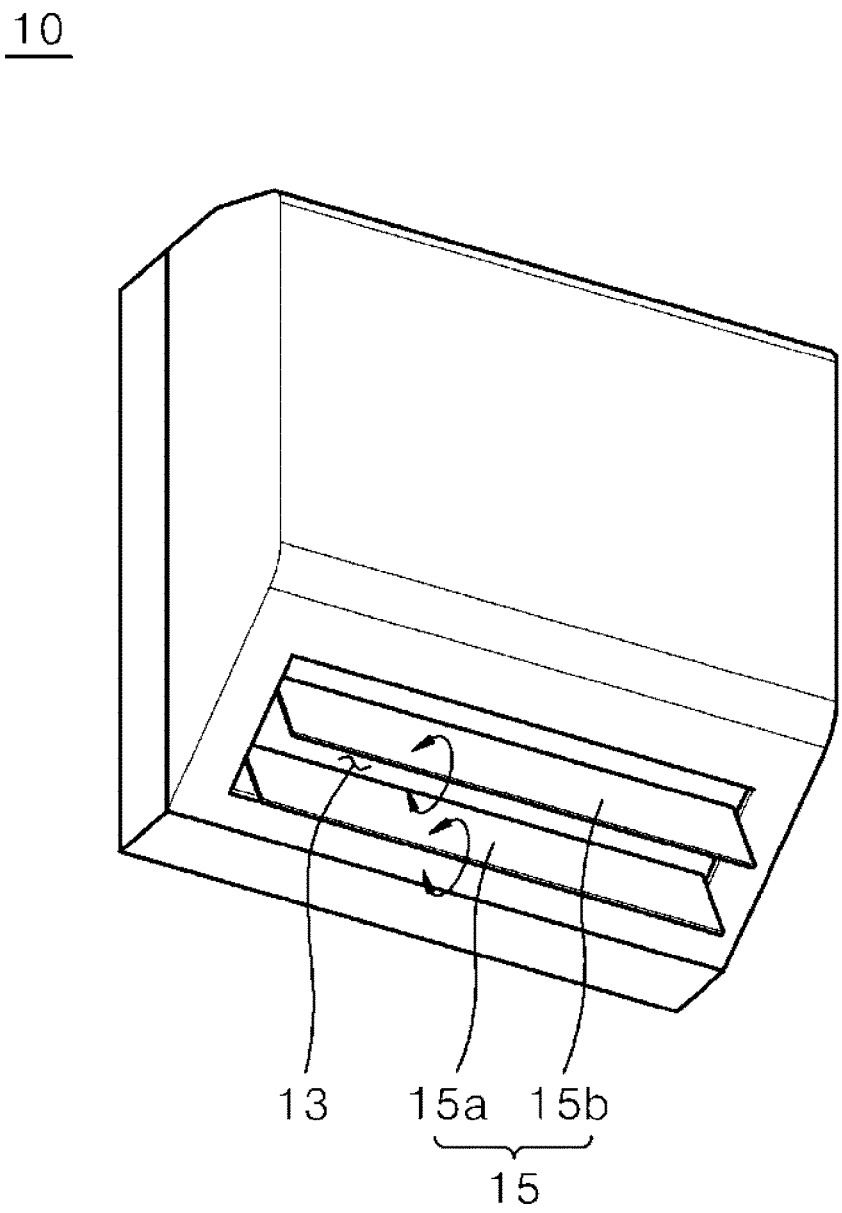
FIGS. 1 and 2 are perspective views of dryers.
Figure 2:
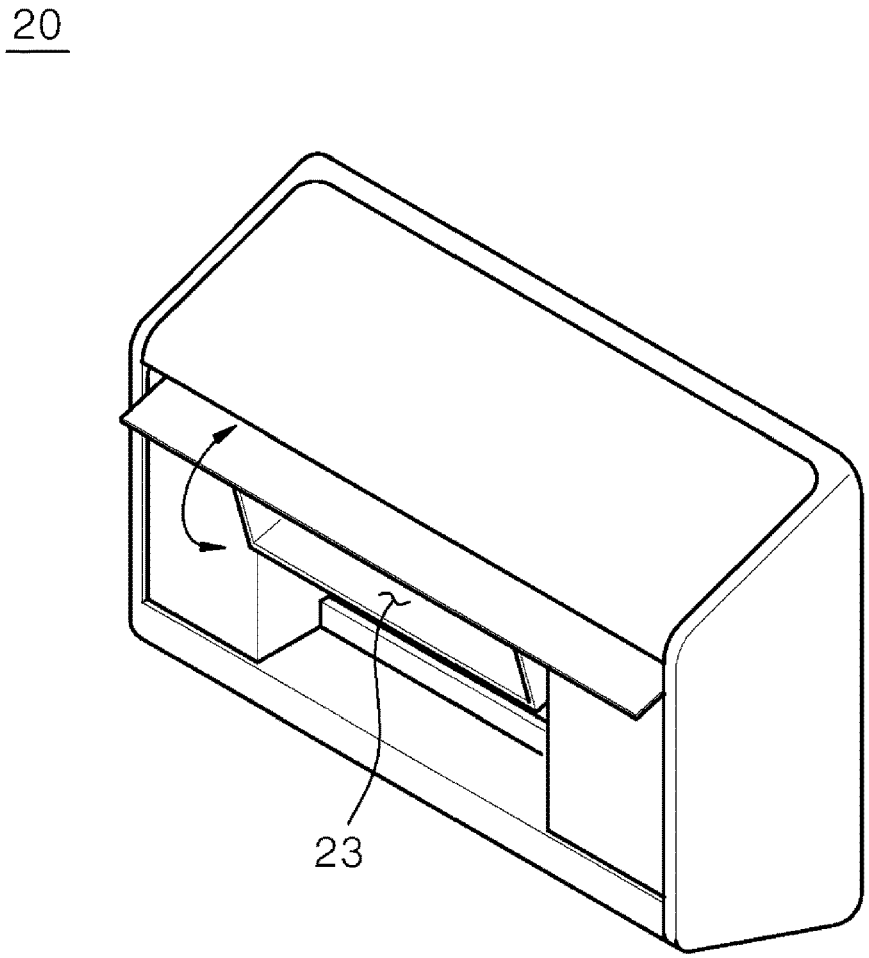
Figure 3:
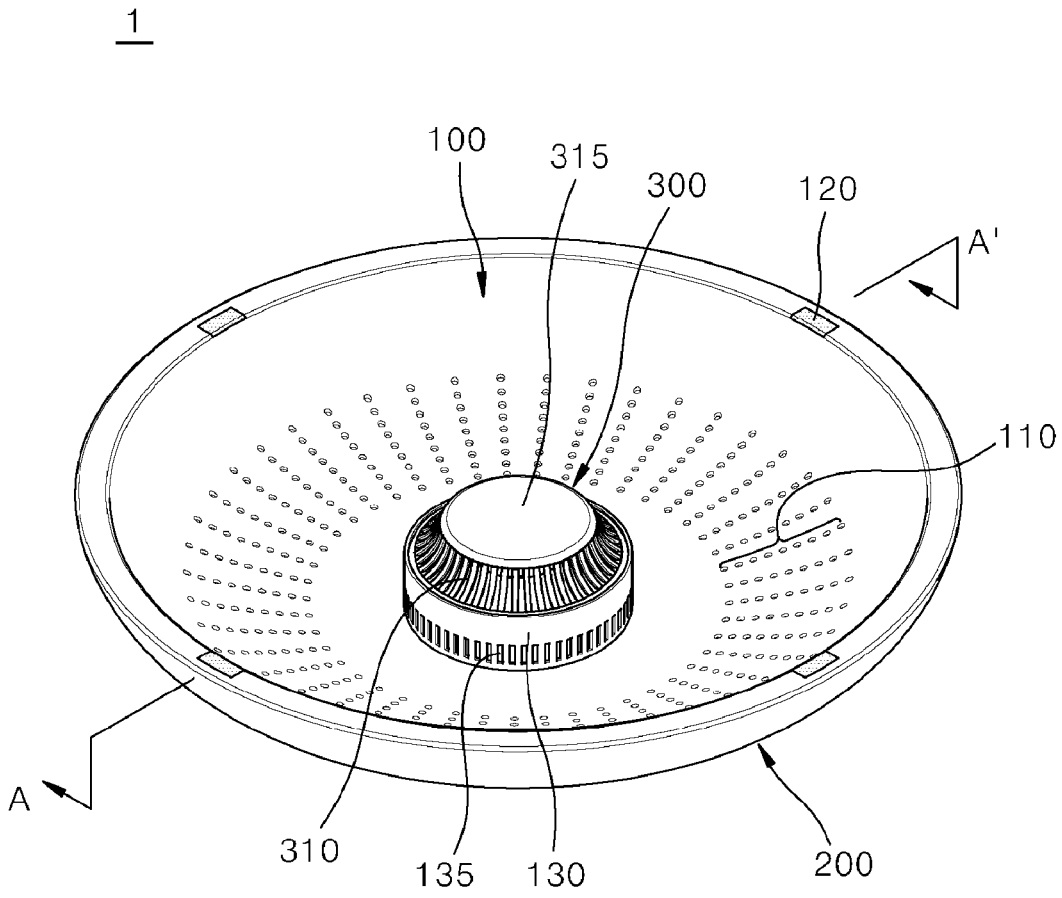
FIG. 3 is a perspective view of a dryer according to an embodiment of the present disclosure.
Figure 4:
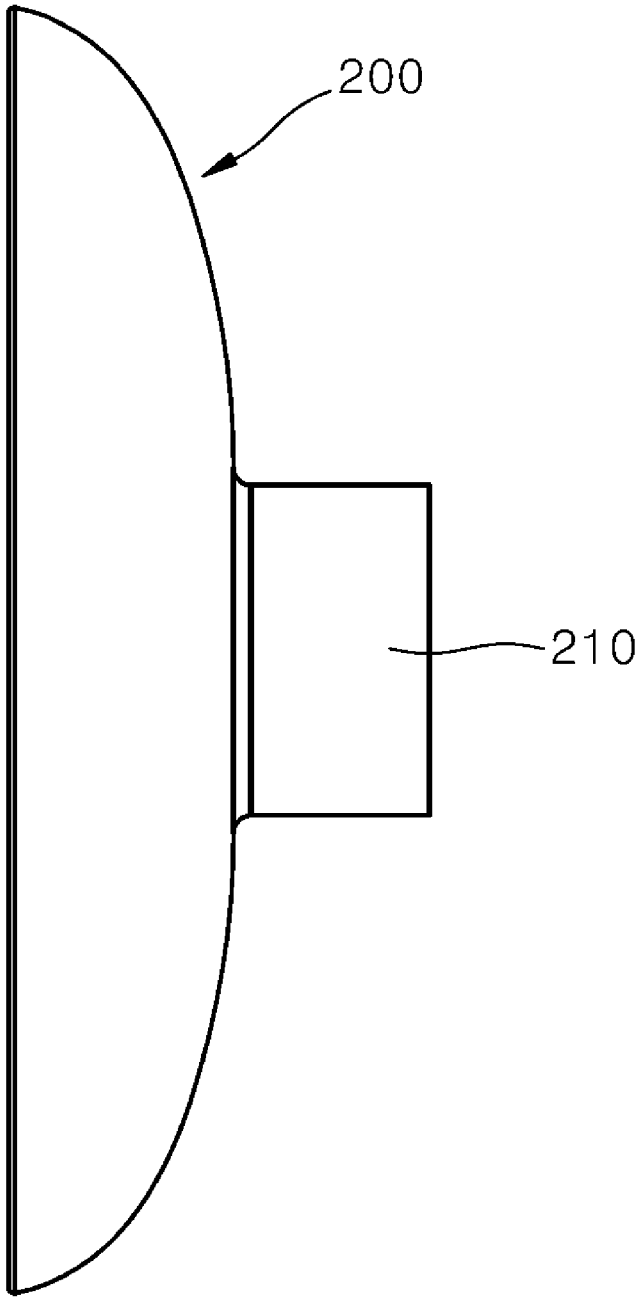
FIG. 4 is a side view of a dryer according to an embodiment of the present disclosure.
Figure 5:
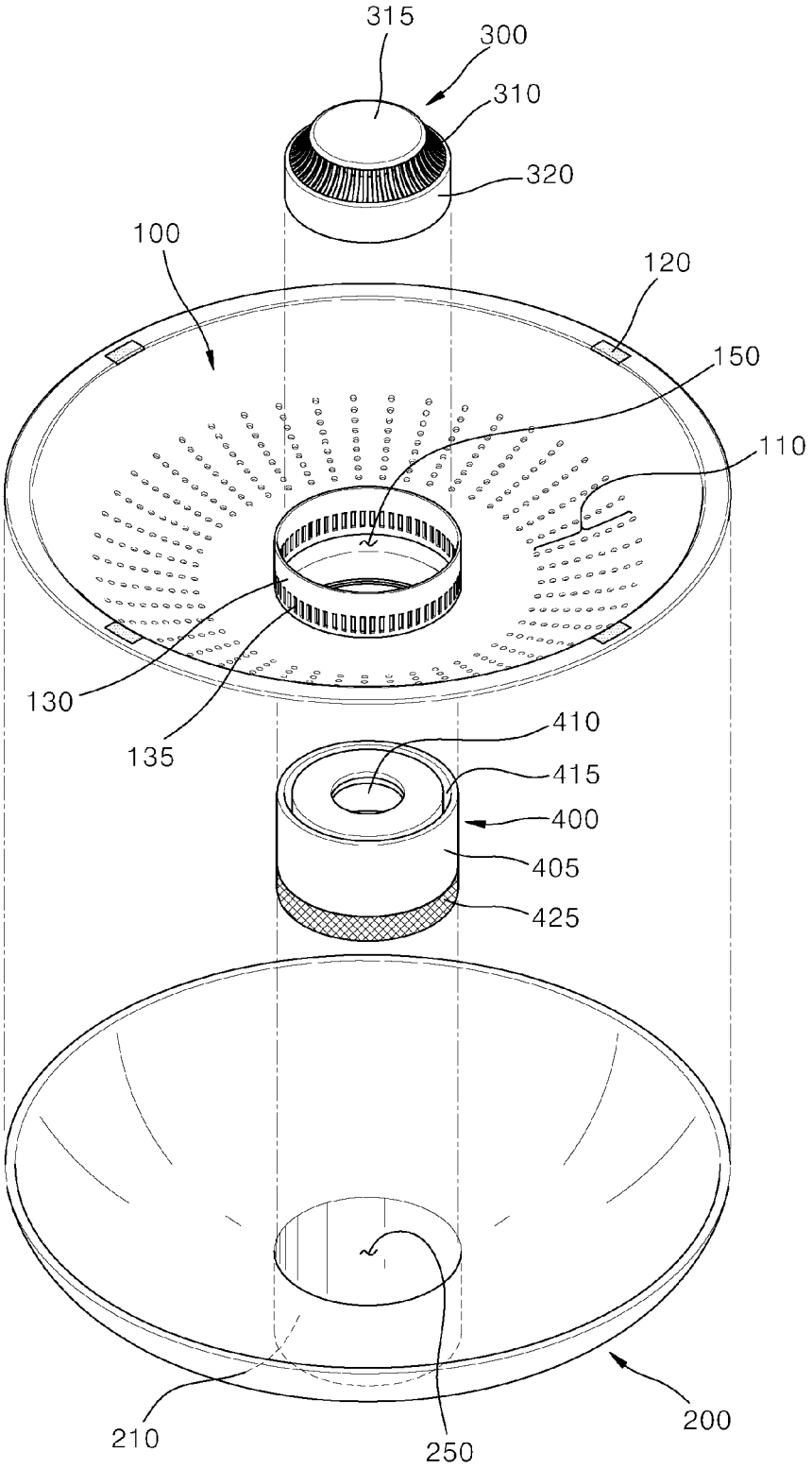
FIG. 5 is an exploded perspective view of a dryer according to an embodiment of the present disclosure.
Figure 6:
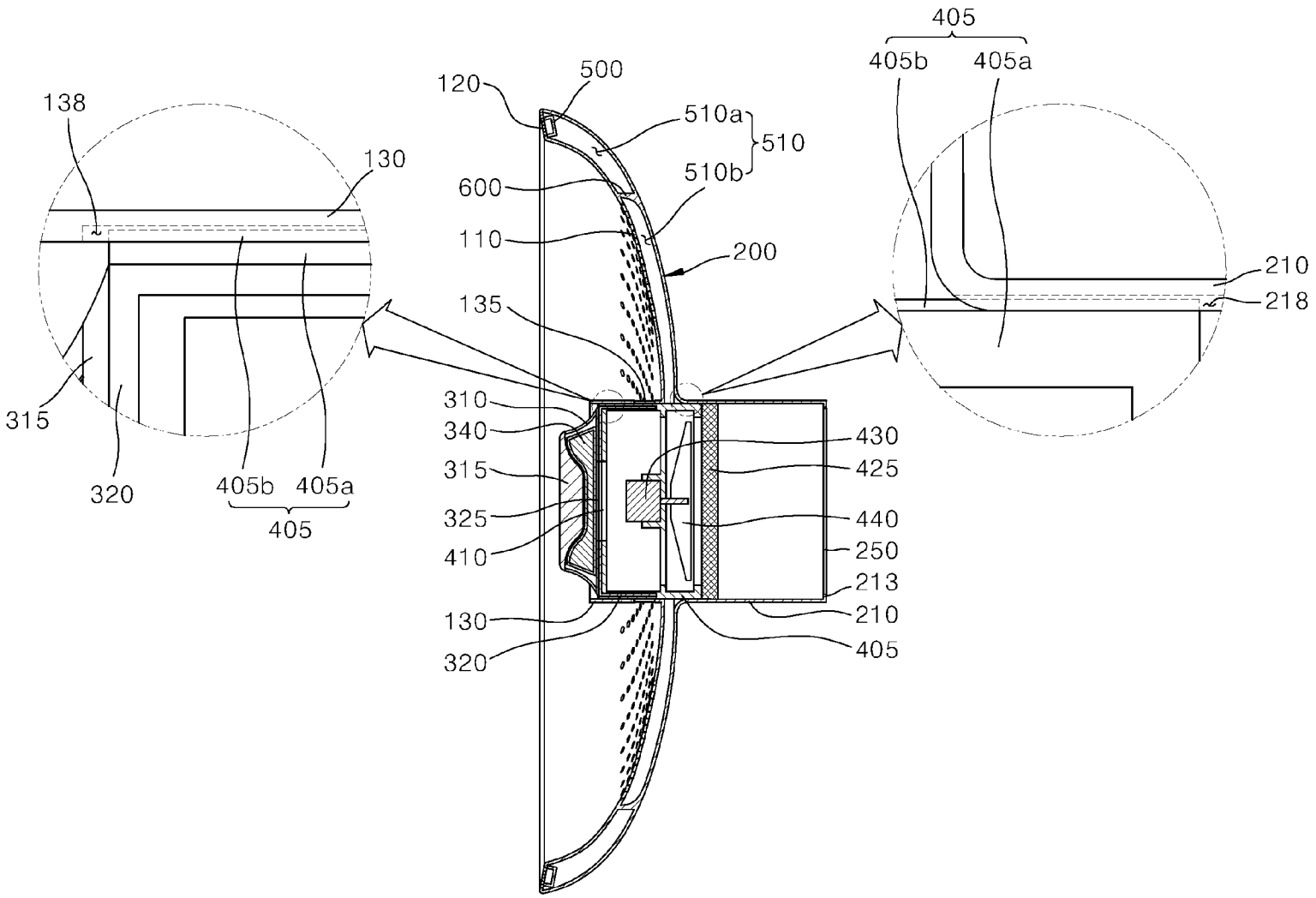
FIG. 6 is a cross-sectional view of the dryer taken along a direction A-A' of FIG. 3.

Hereinafter, with reference to FIGS. 3 to 6, a dryer according to an embodiment of the present disclosure will be described. FIG. 3 is a perspective view of a dryer according to an embodiment of the present disclosure. FIG. 4 is a side view of a dryer according to an embodiment of the present disclosure. FIG. 5 is an exploded perspective view of a dryer according to an embodiment of the present disclosure. FIG. 6 is a cross-sectional view of the dryer taken along a direction A-A' of FIG. 3. Referring to FIGS. 3 to 6, according to an embodiment of the present disclosure, a dryer 1 may include a front case 100, a rear case 200 (or a single case that includes both the front case 100 and the rear case 200), a cover 300, a fan housing 400, a heater 340, and an ionizer 500.

As described herein, the dryer 1 according to an embodiment of the present disclosure may be configured such that the front case 100 and the rear case 200 are separate components. However, the dryer 1 is not limited to this configuration. For example, the front case 100 and the rear case 200 may be configured as an integrated case.

The front case 100 may include a first opening 150 surrounded by an air guide 130 that protrudes forward (e.g., from an outer surface of the front case 100 and in a direction of an air flow generated by the dryer 1) and a plurality of exhaust holes 110 formed around the first opening 150. In certain implementations described herein, the front case 100 may be generally circular when viewed from the front and may be formed to be concaved backward, but the front case 100 is not limited to this configuration. For example, the front case 100 may be a polygonal case. When the front case 100 is a circular case that is formed to be concaved backward, an air flow generated by a blast fan (or fan) 440 may be efficiently directed forward by the front case 100 to dry a user or a bathroom space, as will be described below in detail.

The first opening 150 may be formed in a central portion of the front case 100, and a diameter of the first opening 150 may be larger than a diameter of the individual exhaust hole 110 formed around the first opening 150. The first opening 150 may be formed in the central portion of the front case 100 such that warm air may be uniformly transmitted in all directions along an upper surface of the front case 100 when the dryer 1 is activated.

The first opening 150 may overlap a second opening 250 of the rear case 200. In detail, a diameter of the first opening 150 may be substantially the same as a diameter of the second opening 250 such that a circumference of the first opening 150 corresponds to a circumference of the second opening 250. This configuration enables the fan housing 400 to be coupled to and/or inserted into a passage formed by the first opening 150 and the second opening 250 and to be slideably moved in forward and/or backward directions along the passage defined by the air guide 130 and a housing guide 210. As used herein, the term 'the same' may contain an error range associated with manufacturing process (e.g., differ by less than 5%).

In another implementation, the diameter of the first opening 150 may be intentionally designed to be different from the diameter of the second opening 250. When the diameter of the first opening 150 differs from the diameter of the second opening 250, a support (or sleeve) may be installed at the first opening 150 or the second opening 250 to prevent the fan housing 400 from shaking when coupled to or inserted into the first opening 150 and the second opening 250.

The air guide 130 may be formed to surround the first opening 150 at the central portion of the front case 100. In one embodiment, the air guide 130 may be a separate component that is coupled to a front surface of the front case 100. In another embodiment of the present disclosure described herein and depicted in the figures, the air guide 130 is integrated into and included in the front case 100. For example, the air guide 130 may protrude forward to surround a periphery of the first opening 150. A diameter of an inner circumference surface of the air guide 130 may be substantially the same as a diameter of the first opening 150, but the diameter of the inner circumference surface of the air guide 130 and the diameter of the first opening 150 may be different in other examples. However, the diameter of the inner circumference surface of the air guide 130 is sufficiently large such that the fan housing 400, when inserted in the first opening 150, can be slidably moved forward and/or backward within the air guide 130, as needed.

In addition, the diameter of the air guide 130 may be the same as the diameter of the housing guide 210 but is not limited thereto, and other examples, the diameter of the air guide 130 and the diameter of the housing guide 210 may be different. As previously described, when the diameter of the air guide 130 and the diameter of the housing guide 210 are sufficiently different, a support or sleeve may be further installed around at least a portion of the fan housing 400 to prevent the fan housing 400 from shaking while being moved forward and/or backward along the passaged defined by the air guide 130 and the housing guide 210.

The air guide 130 may include an exhaust vent 135 formed in a lower portion thereof. For example, the exhaust vent 135 may be positioned near at a proximal end of the air guide 130 coupled to the outer surface the first case 110, and away from a distal end of the air guide 130. In detail, the exhaust vent 135 may include a plurality of exhaust vents holes that may be spaced apart along a circumference of the air guide 130. As shown in the figures, each of the holes of the exhaust vent 135 may be formed in an oblong shape that extends in an axial direction of the air guide 130. In another implementation, the exhaust vent 135 may be formed as a single exhaust vent hole formed at the lower portion of the air guide 130. For example, the single exhaust vent 135 may extend along a circumference direction of the air guide 130.

For reference, depending on a relative position of a heater 340 within the air guide 130, an output direction of an air flow that is heated by and outputted from the heater 340 may be modified, as will be described below in detail. As described herein, the air flow that is received, heated, and outputted from the heater 340 may be referred to as a heated air flow or a warmed air flow.

The plurality of exhaust holes 110 may be formed around the first opening 150. In one example, the plurality of exhaust holes 110 may be spaced apart from each other at a substantially constant interval and may be arranged in substantially vertical lines that extend between the first opening 150 and an edge of the front case 100. For example, the plurality of exhaust holes 110 may be spaced apart from each other at a constant interval in up and down (e.g., vertical) directions extending axially from the first opening 150, and some of the exhaust holes 110 may be arranged in lines between the air guide 130 and an ion outlet 120. Respective groups of the exhaust holes 110 may be positioned into the vertical lines, and as illustrated in the figures, the lines or groups of the exhaust holes 110 may be spaced apart from each other at a constant interval in right and left (e.g., horizontal) directions along a circumference of the air guide 130. The warm air outputted from by the heater 340 may be directed through the plurality of exhaust holes 110 to create a low pressure air flow over a wide area to softly dry a user or a space, as compared with a general dry mode in which the warm air is provided over a smaller area at higher pressures, as will be described below in detail.

The rear case 200 may be coupled to the front case 100 and may include the second opening 250 surrounded by the housing guide 210 that protrudes backward (e.g., extending from a rear surface of the rear case in a direction away from an air flow outputted by the heater 340). In the examples shown in the figures, the rear case 200 may be a circular case formed to be concave backward, but the shape of the rear case 200 is not limited thereto. For example, the rear case 200 may be a polygonal case.

The rear case 200 may be formed to have a similar shape and form as the front case 100 except that the housing guide 210 protrudes backward, the ion outlet 120 is not included, and the plurality of exhaust holes 110 are not included. In other examples, the rear case 200 may be larger in size than the front case 100 and/or may have a different shape from the front case 100. For example, the rear case 200 may have a polygonal shape while the front case 100 has a circular shape. However, for convenience of description, according to an embodiment of the present disclosure, an example in which the rear case 200 and the front case 100 are formed with similar shapes will be described below.

When the rear case 200 and the front case 100 are coupled, an internal space 510 may be formed therebetween. Since the rear case 200 may be formed to have a similar shape to the front case 100, air may flow in the internal space 510 along a shape of a rear surface of the front case 100 and a front surface of the rear case 200.

The second opening 250 may be formed in a central portion of the rear case 200 and may overlap the first opening 150 of the front case 100. As previously described, a diameter of the second opening 250 may be the substantially same as a diameter of the first opening 150 such that a circumference of the second opening 250 may correspond to a circumference of the first opening 150. This configuration enables the fan housing 400 to be coupled to or inserted into the first opening 150 and the second opening 250 and to be slid in forward and/or backward directions along a passage defined by the air guide 130 and the housing guide 210. In another example, the diameter of the second opening 250 may be different from the diameter of the first opening 150, and a support (or sleeve) may be further installed to prevent the fan housing 400 from shaking when coupled to or inserted into the second opening 250 and the first opening 150.

The housing guide 210 may be formed to surround the second opening 250 formed in the central portion of the rear case 200. For example, the housing guide may extend from a rear surface of the second case 200 around a peripheral edge of the second opening 250. In an embodiment of the present disclosure shown in the figures, the housing guide 210 may be integrally coupled to the rear case 200. In other examples, the housing guide 210 may be separately formed from the rear case 200. For example, the housing guide may be a separate component that is coupled to a rear surface of the rear case 200.

In detail, the housing guide 210 may protrude backward to surround the second opening 250. A diameter of an inner circumference surface of the housing guide 210 may be substantially the same as a diameter of the second opening 250 but is not limited thereto. In particular, the diameter of the inner circumference surface of the housing guide 210 may be a sufficiently large size to couple to or receive the fan housing 400 such that the fan housing can be slidably moved forward and/or backward within the housing guide 210. In addition, the diameter of the housing guide 210 may be substantially the same as the diameter of the air guide 130 but is not limited thereto. When the diameter of the housing guide 210 and the diameter of the air guide 130 are different, a support (or sleeve) may be further installed around a portion of the fan housing 400 to prevent the fan housing 400 from shaking within the passage defined by the housing guide 210 and the air guide 130.

In addition, the housing guide 210 may include an end projection 213 at one side thereof. In one example, the end projection 213 may be formed to protrude toward the center of the second opening 250 and in a direction perpendicular to the housing guide 210. In another example, the second opening 250 may be provided at a bias or angle along the housing guide 210 such that one side of the housing guide 210 may be positioned farther from the front case 100 than the other side of the housing guide 210. In this second example, the end projection 213 may be provided on the side of the housing guide that is closer to the first case 100. In operation, the end projection 213 may engage an end of the fan housing 400 to prevent the fan housing 400 from being separated out of the dryer 1 (e.g., moving through the second opening 250) while the fan housing 400 is moved within the housing guide 210.

The cover 300 may be formed on the fan housing 400 to cover and enclose the heater 340. In one example shown in the figures, the dryer 1 according to an embodiment may be configured in such a way that the cover 300 can be separated from the fan housing 400. In another example, the cover 300 may be integrally formed with the fan housing 400.

In detail, the cover 300 may include a cap 315, an outlet 310, and an inserting portion (or inserting cylinder) 320. Here, the cap 315 may be formed to cover the heater 340 and may include a heat insulating material (hot shown) positioned between the cap 315 and the heater 340. That is, the cap 315 may include the heat insulating material to insulate heat generated by the heater 340, thereby preventing a user from being burned due to the heater 340. A third opening 325 may be formed below a central portion of the cap 315 (e.g., at a portion of the cover 300 positioned in the air path from the blast fan 440) such that an air flow generated by the blast fan 440 is transmitted to the heater 340 positioned within a cavity within the cover 300.

The outlet 310 may be formed in a lateral surface of the cap 315 and may pass an air flow ejected from the heater 340 therethrough. As shown in the figures, a plurality of outlets 310 may be included in the cover 300, but in other examples, the cover 300 may include a single outlet 310 instead of the plurality of outlets 310. The outlets 310 may be elongated in a direction between the cap 315 and the insertion portion 320.

The inserting portion 320 may be formed at a lower end of the cap 315 and inserted into an inserting hole 415 of the fan housing 400. The inserting portion 320 of the cover 300 may be inserted into the inserting hole 415 of the fan housing 400 to stably cover the fan housing 400 and the heater 340 formed on the fan housing 400. The inserting portion 320 may be formed to not overlap the third opening 325 formed in the lower end of the cap 315 to transmit the air flow generated by the blast fan 440 to the heater 340. In another example, the cover 300 may be connected to the fan housing 400 using a different method that does not use the insertion portion 320, such as coupling the lower end of the cap 315 of the cover 300 and an upper end of the fan housing 400 via adhesives.

The fan housing 400 may be inserted within the first opening 150 and the second opening 250, may be moveable in forward and/or backward directions along the air guide 130 and the housing guide 210, and may include the blast fan 440. In detail, the fan housing 400 may include a fourth opening 410, the inserting hole 415, a body portion (or body cylinder) 405, and a suction port 425.

The fourth opening 410 may be formed on an upper surface of the fan housing 400, and an air flow generated by the blast fan 440 may be provided to the heater 340 through the fourth opening 410. For example, the fourth opening 410 may be positioned to face the third opening 325 such that the air flow generated by the blast fan 440 moves out of the fan housing 400 through the fourth opening 410 and into the cover 300 through the third opening 325 to be received by the heater 340. The inserting hole 415 may be formed along an edge of the body portion 405, and, the inserting portion 320 of the cover 300 may be inserted into the inserting hole 415 to stably couple the fan housing 400 to the cover 300. The body portion 405 may function as a main body of the fan housing 400 and may include a motor 430 installed therein to drive the blast fan 440 and the blast fan 440.

Here, it may be seen that a first slide hole 138 formed to be concave inward is formed in the air guide 130 and a slide protrusion **405*b* is formed at an outermost portion of the body portion 405. That is, the body portion 405 may include the slide protrusion 405*b* and a portion (or side wall) 405*a* that is separate from the slide protrusion 405*b*. The slide protrusion 405*b* of the body portion 405 may be coupled to the first slide hole 138 of the air guide 130 to slide and, thus, the fan housing 400 may be moved along the air guide 130**.

A second slide hole 218 having a concaved inward shape may also be formed in the housing guide 210, and the slide protrusion **405*b* of the body portion 405 may be coupled to the second slide hole 218 of the housing guide 210 to slide within the housing guide 210. Accordingly, the fan housing 400 may also be slidably moved along the housing guide 210**.

The suction port 425 may be formed in a lower end of the body portion 405 and may include a plurality of intake ports. That is, when the blast fan 440 is operated to generate an air flow, the blast fan 440 sucks in external air through the second opening 250 and into the body portion 405 through the intake port of the suction port 425.

The fan housing 400 may include the motor 430 and the blast fan 440. In detail, upon receiving an input from a user selecting a desired air flow mode, the motor 430 may drive the blast fan 440 based on the selected air flow mode. For example, the blast fan 440 may be selectively driven by the motor 430 to generate different flow rates and/or different air flow pressures. The motor 430 may receive power from a power source (not shown). Here, the power source may be, for example, an internal battery or an external commercial power source.

The heater 340 may be positioned relative to the fan housing 400 to receive and heat an outputted air flow generated by the blast fan 440. In one example, the dryer 1 according to an embodiment of the present disclosure may be configured in such a way that the cover 300 and the fan housing 400 may be integrally formed, and thus, the heater 340 may be positioned in the fan housing 400. According to another embodiment of the present disclosure, the cover 300 is separately provided from the fan housing 400, such that the cover 300 positions the heater 340 adjacent to the fan housing 400, as will be described below.

In detail, the heater 340 may be formed on the fan housing 400 and surrounded by the cap 315. As previously described, the third opening 325 may be formed in the lower end of the cover 300, and an air flow generated by the blast fan 440 may be provided to the heater 340 via the third opening 325. As described below, an output direction of an air flow heated by the heater 340 and ejected through the outlet 310 may be changed in response to a forward and/or backward movement of the fan housing 400 within a passage defined by the housing guide 210 and the air guide 130.

The ionizer 500 may be provided at one end of the internal space 510 formed between the front case 100 and the rear case 200. Here, the one side of the internal space 510 may be positioned farther from the housing guide 210 than the other side of the internal space 510, and the internal space 510 may include a first space 510*a* and a second space 510*b*. The first space 510*a* may be a space extending between one side of a blocking projection 600 and the air guide 130, and the second space 510*b* may be a space extending between another side of the blocking projection 600 and the ionizer 400. The front case 100 may include the ion outlet 120 formed at a portion that overlaps the ionizer 500, and the ionizer 500 may discharge ions out of the dryer 1 through the ion outlet 120. Through negative ions discharged from the ionizer 500, the air flow generated by the blast fan 440 may be sanitized to remove unwanted germs and/or viruses. In another example, the ionizer 500 may also discharge active hydrogen with the negative ions to further enhance the removal of germs and virus from the heated air flow.

For reference, the blocking projection 600 may be provided in the internal space 510 and may connect the front case 100 and the rear case 200. The blocking projection 600 may extend between the front case 100 and the rear case 200 at a position that is radially farther from the air guide 130 than any of the plurality of exhaust holes 110.

Figure 7:
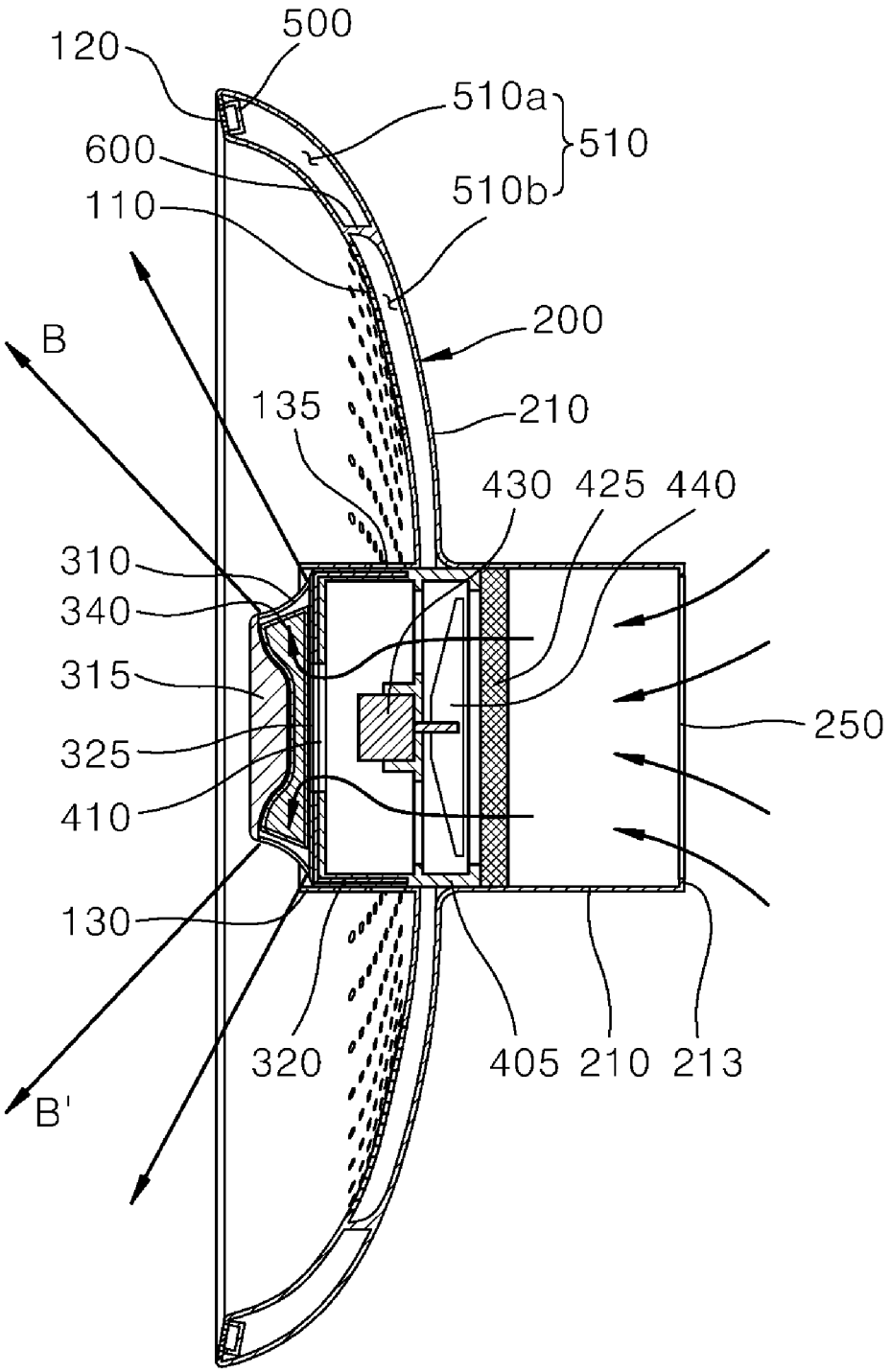
FIG. 7 is a diagram for explanation of a first wind mode of a dryer according to an embodiment of the present disclosure.
Figure 8:
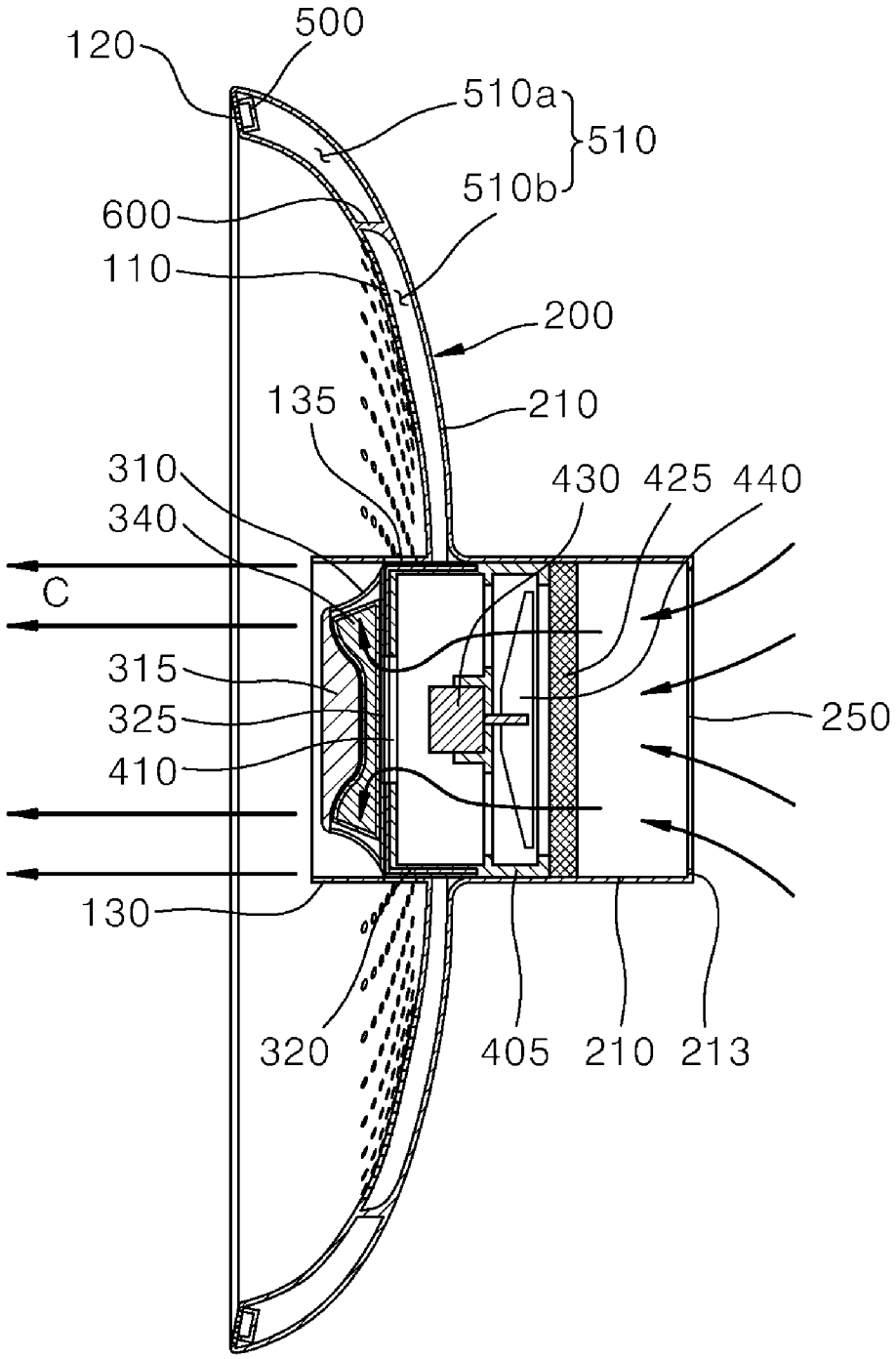
FIG. 8 is a diagram for explanation of a second wind mode of a dryer according to an embodiment of the present disclosure.
Figure 9:
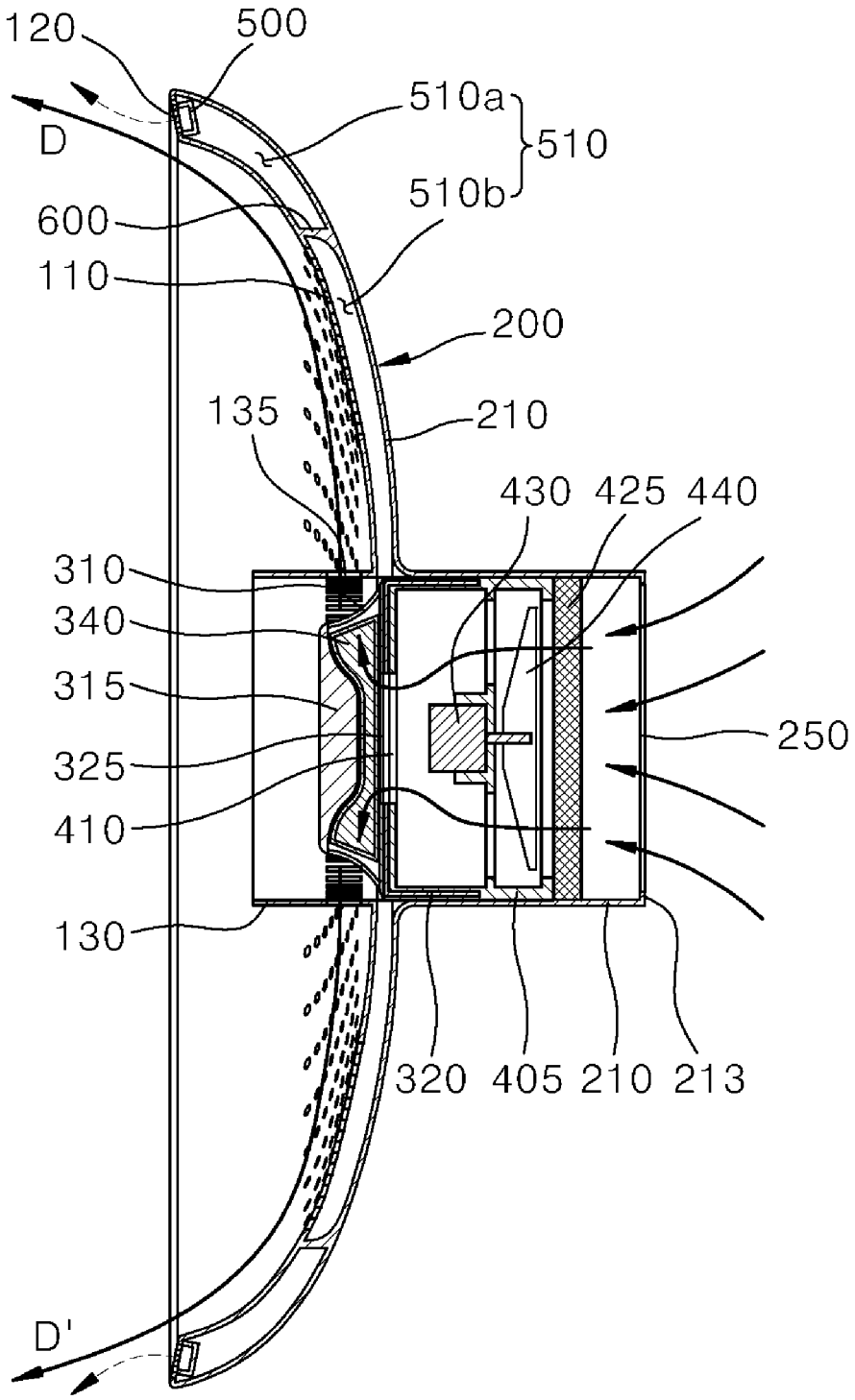
FIG. 9 is a diagram for explanation of a third wind mode of a dryer according to an embodiment of the present disclosure.
Figure 10:
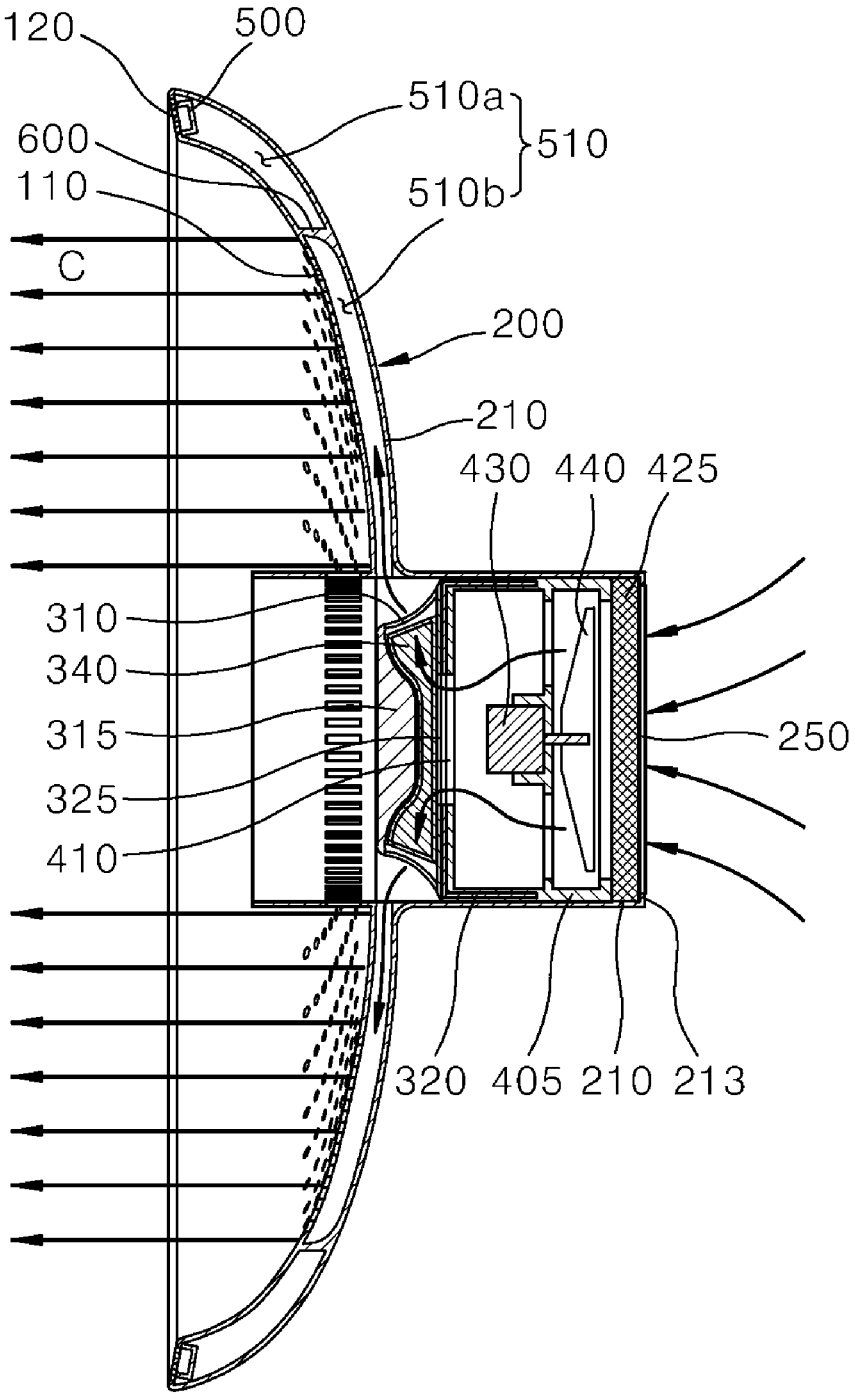
FIG. 10 is a diagram for explanation of a fourth wind mode of a third wind mode of a dryer according to an embodiment of the present disclosure.

Hereinafter, a wind (or air flow) mode of a dryer 1 according to an embodiment of the present disclosure will be described with reference to FIGS. 7 to 10. FIG. 7 is a diagram for explanation of a first wind mode of a dryer according to an embodiment of the present disclosure. FIG. 8 is a diagram for explanation of a second wind mode of a dryer according to an embodiment of the present disclosure. FIG. 9 is a diagram for explanation of a third wind mode of a dryer according to an embodiment of the present disclosure. FIG. 10 is a diagram for explanation of a fourth wind mode of a third wind mode of a dryer according to an embodiment of the present disclosure.

For reference, according to the present disclosure, although only the first to fourth wind modes are described, the present disclosure is not limited thereto. For example, each of the first to fourth wind modes may be divided into more detailed wind mode, and a distance or direction by which the fan housing 400 is moved in the forward and/or backward directions within the air guide 130 and the housing guide 210 may be subdivided to add other wind modes other than the first to fourth wind modes. For example, the fan housing 400 may be positioned between locations associated with the first to fourth mode to achieve a hybrid mode in which the air flow is outputted in directions associated with two or more of the modes. However, for convenience of description, according to the present disclosure, only the first to fourth wind modes will be discussed.

Figure 11:
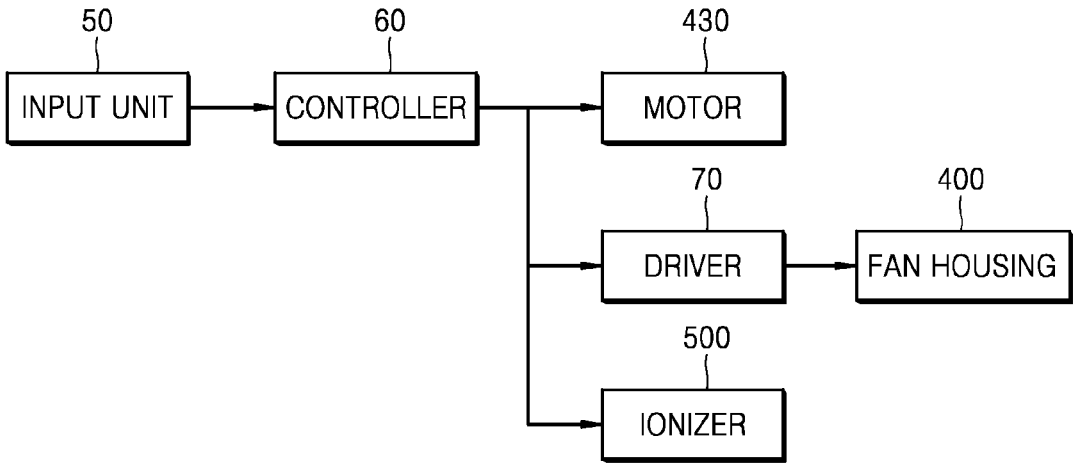
FIG. 11 is a block diagram illustrating a flow of a control signal of a dryer according to an embodiment of the present disclosure.

An volume of air flow generated by the blast fan 440 may be set for each of the first to fourth wind modes through a controller 60 (refer to FIG. 11). For example, the blast fan 440 may be controlled to rotate at different speeds in the different modes to produce different volumes of air flow during the different modes. However, for convenience of description, an example in which the blast fan 440 generates an air flow with a substantially same air volume in each of the first to fourth wind modes will be described below. Furthermore, a volume of the outputted air flow may also vary depending on changes in the relative positioning of the air flow outputted from the heater 340 and the air guide 130, as will be described below in detail.

FIG. 7 illustrates the dryer 1 operating in the first wind (or a first air flow) mode. When the dryer 1 is operated in the first wind mode, a distal outer end of the air guide 130 does not overlap or otherwise block a proceeding path of a warm air flow outputted from the heater 340, and the air flow outputted from the heater 340 may be provided in first and second diagonal directions B and B' through the outlet 310 in the cover 300. For example, the first wind mode may be associated with the cover 300 and the fan housing 400 being positioned relatively forward within the passage defined by the air guide 130 and the housing guide 210 such the air flow from the outlet 310 is not effected by the air guide 130.

In detail, when the dryer 1 is operated in the first wind mode, the blast fan 440 may be driven by the motor 430 to rotate and, thus, cause external air to be sucked into the body portion 405 through the suction port 425, as represented by arrows passing through the second opening 250 of the rear case 200 in FIG. 7. Air sucked into the body portion 405 may be directed through the heater 340 to be heated, as represented by the arrows passing through the suction port 425, the blast fan 440, and the heater 340 in FIG. 7. In the first wind mode, the outer end of the air guide 130 does not overlap the proceeding path of warm air flow ejected from the heater 340 through the opening 310 (as represented by the diagonal directions B and B') and, thus, the warmed air flow outputted from the heater 340 may continue along the first and second diagonal directions B and B'.

As shown in FIG. 7, the path of the warmed air flow outputted from the heater 340 in the first wind mode is relatively forward so as to avoid the distal, forward end of the air guide 130. Thus, the air flow ejected from the heater 340 may be outputted without change in proceeding path along the first and second diagonal directions B and B'. Here, the first and second diagonal directions B and B' may refer to a diagonal direction based on an upper surface of the fan housing 400, as illustrated in the drawing. In another example, the first and second diagonal directions B and B' may be asymmetrical with respect to the upper surface of the fan housing 400, such that more air may be concentrated in one or more directions. For example, portions of the outlet 310 may be angled, sized, or shaped to output the air flow asymmetrically. The dryer 1 may be operated in the first wind mode to provide a high volume of warmed air over a relatively large output angle, such as to dry a user's body after bathing.

FIG. 8 illustrates the dryer 1 that being operated in the second wind mode (or second air flow mode). When the dryer 1 is operated in the second wind mode, the outer, distal end of the air guide 130 may overlap the proceeding path of wind ejected from the heater 340 (e.g., directions B and B' shown in FIG. 7), and the internal surface of the air guide 130 may redirect the heated air flow ejected from the heater 340 to a substantially forward direction "C".

As with the first wind mode, when the dryer 1 is operated in the second wind mode, the blast fan 440 connected to the motor 430 may be driven by the motor 430 such that external air may be sucked into the body portion 405 through the suction port 425, and air sucked into the body portion 405 may be directed to the heater 340 to form a warm air flow. In the second wind mode, the fan housing 400 may be moved backward (e.g., away from an opening at the distal end of the air guide 130) compared with in the first wind mode. In this position, the end of the air guide 130 may overlap the direction of the air flow ejected from the heater 340 via the outlet 340, and the internal surface of the air guide 130 may redirect the warm air flow ejected from the heater 340 in the forward direction "C".

That is, the outer end of the air guide 130 may be provided to block the proceeding path of the air flow ejected from the heater 340 and, thus, the proceeding path of wind ejected from the heater 340 may be changed to the forward direction "C" from the first and second diagonal directions B and B' (refer to FIG. 7). Here, the forward direction "C" may refer to a direction perpendicular to the upper surface of the fan housing 400, as illustrated in FIG. 8. The dryer 1 may be operated in the second wind mode to provide a focused warm air flow within a relatively smaller region, and this focused warm air flow may provide for more intense drying in comparison to the first wind mode, such as to quickly dry a part of the user's body, such as the user's hands.

FIG. 9 illustrates the dryer 1 when operated in the third wind mode (or third air flow mode). When the dryer 1 is operated in the third wind mode, the cover a 300 and the fan housing are positioned further within a passage formed by the air guide 130 and the housing guide 210 in comparison to the first and the second wind modes. In this position, the warm air flow outputted through the outlet 310 is directed toward the exhaust vent 135 of the air guide 130. Accordingly, a substantially portion of the warm air flow ejected from the heater 340 passes through the exhaust vent 135 and moves along a front, outer surface of the front case 100 and, then, ions provided by the ionizer 500 may be injected into the warm air flow.

As with the first and second wind modes, when the dryer 1 is operated in the third wind mode, the blast fan 440 is driven by the motor 430 to suck external air into the body portion 405 through the suction port 425, and the air sucked into the body portion 405 is heated by the heater 340 and ejected through the outlet 310. In this case, the fan housing 400 may be moved backward (e.g., away from the distal end of the air guide 130) compared with in the second wind mode, such that the exhaust vent 135 of the air guide 130 is positioned to overlap the output path of air flow from the heater 340. Thus, a substantial portion of the warm air flow from the heater 340 may pass through the exhaust vent 135 and may move along the output front surface of the front case 100. As the warm air flow passes along the output front surface of the front case 100, the warm air flow may be provided with disinfecting ions discharged from the ionizer 500 via the ion outlet 120.

Here, a proceeding path of the airflow along the outer front surface of the front case 100 and receiving the ions discharged from the ionizer 500 may be represented by third and fourth diagonal directions D and D' shown in FIG. 9. As illustrated in FIG. 9, the third and fourth diagonal directions D and D' may refer to a diagonal direction relative to an upper surface of the fan housing 400 that extends along the outer front surface of the first case 100 and are may be different from the first and second diagonal directions B and B' associated with uninterrupted the warm air flow outputted from the outlets 310, as shown in FIG. 7. In certain implementations, the front surface of the first case 100, the outlet 310, the heater 340 or other aspects of the heater 1 may be designed such that the third and fourth diagonal directions D and D' are asymmetrical with respect to the upper surface of the fan housing 400.

The dryer 1 may be operated in the third wind mode, for example, to dry and disinfect a bathroom space. For example, when the dryer 1 is operated in the third wind mode, the warm air flow may be directed over a wider area in comparison to the first and second wind modes. In addition, the ions discharged by an ionizer 500 may be distributed through the bathroom through the warm air flow in the third and fourth diagonal directions D and D' such that the third wind mode may be used to remove germs and viruses in the bathroom. Furthermore, as previously described the ionizer 500 (or another component of the dryer 1) is also discharge active hydrogen to remove germs and viruses during the third wind mode, and since the third wind mode distributes the warm air flow at a lower air pressure over a wider region, the active hydrogen is not excessively disturbed by the air flow.

FIG. 10 illustrates the dryer 1 operated in the fourth wind mode (or fourth air flow mode). When the dryer 1 is operated in the fourth wind mode, the cover 300 and the fan housing 400 are moved further back within the passage formed by the air guide 130 and the housing guide 210 in comparison to the first to third modes. For example, the cover 300 and the fan housing 400 are moved further back so that a rear surface of the fan housing (e.g., an edge of the suction port 425) contacts the end projection 213. At this position, the cover 300 and the fan housing 400 positions the outlet 310 adjacent to an opening of the internal space 510. Thus, a substantial portion of the warm air flow outputted from the heater 340 (e.g., in the directions B and B' shown in FIG. 7) may be directed into the internal space 510 and to be discharged through the plurality of exhaust holes 110.

As previously described with respect to the first to third wind modes, when the dryer 1 is operated in the fourth wind mode, the blast fan 440 is driven by the motor 430 to rotate to suck external air into the body portion 405 through the suction port 425, and the air sucked into the body portion 405 may be heated and outputted through the heater 340. In the fourth wind mode, the fan housing 400 is moved backward in comparison to the first to third wind modes such that the internal space 510 is adjacent to and overlaps the path of warm air flow outputted from the heater 340 through the outlet 310. Accordingly, a substantially portion of the air flow outputted from the heater 340 may move along the internal space 510 and may be discharged through the plurality of exhaust holes 110 of the front case 100.

In the fourth wind mode, a direction of warm air flow discharged through the plurality of exhaust holes 110 of the front case 100 corresponds to a front direction "C". Thus, in the fourth wind mode, the warm air flow from the heater 340 is distributed in a similar direction but over a relatively larger region through the exhaust holes 110 in comparison to the first wind mode so that the warm air flow has a relatively lower air pressure in the fourth wind mode. Accordingly, the fourth wind mode may be appropriate to slowly dry a user body over a wide area and to prevent over drying or even burning the user.

Figure 12:
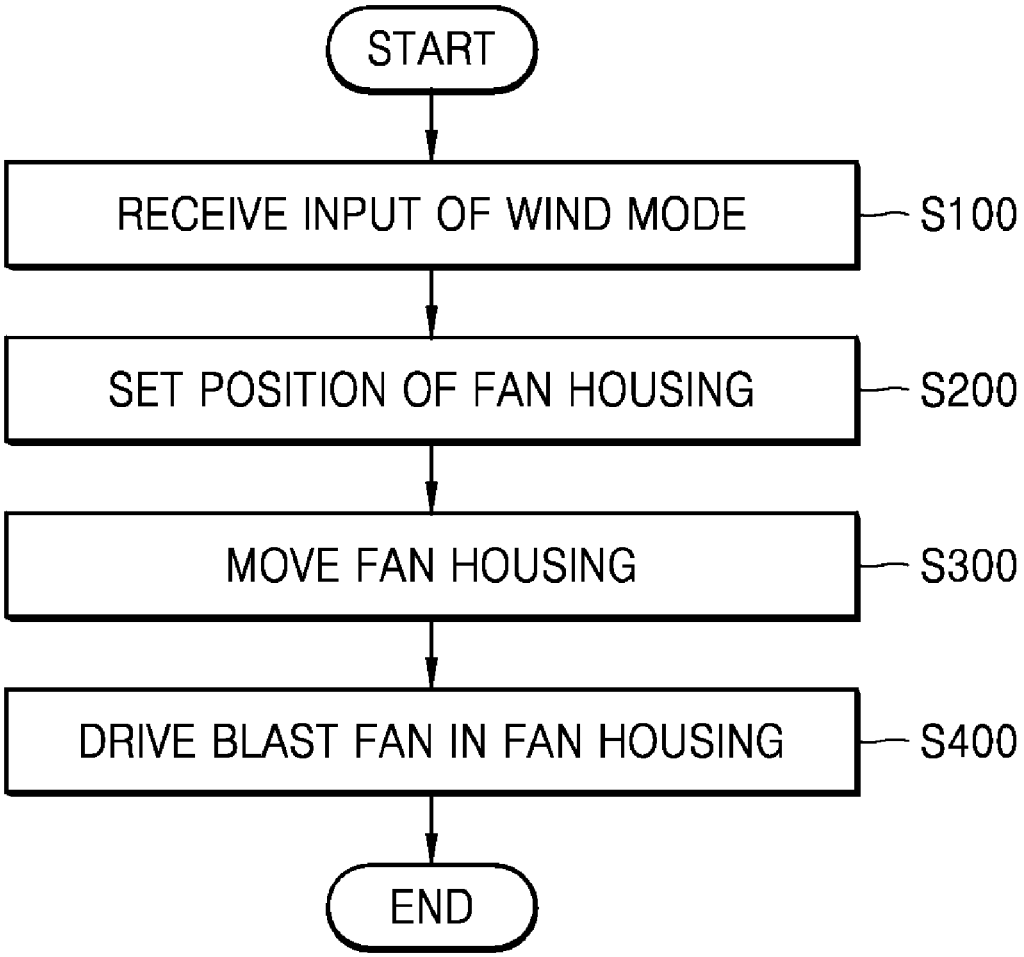
FIG. 12 is a flowchart for explanation of a method of controlling a dryer according to an embodiment of the present disclosure.

Hereinafter, a method of controlling a dryer according to an embodiment of the present disclosure will be described in detail with reference to FIGS. 11 and 12. FIG. 11 is a block diagram illustrating a flow of a control signal of a dryer according to an embodiment of the present disclosure. FIG. 12 is a flowchart for explanation of a method of controlling a dryer according to an embodiment of the present disclosure.

Referring to FIGS. 6, 11, and 12, first, the controller 60 may receive an input related to a selection of a wind mode of the dryer 1 from an input unit (or input device) 50 (S100). For reference, although not illustrated, the controller 60 and the input unit 50 may be installed outside or inside the dryer 1. In particular, the input unit 50 may be formed on, an external portion of the dryer 1, such as an external surface of the housing guide 210, and may include a button, touch-screen, or other input mechanism to receive an input from a user. In another example, the input unit 50 may include a wireless communication module that includes an antenna and transceiver, and the user may provide an input to the input unit 50 using a remote device, such as remote controller, a smartphone, or the like to transmit a control signal that is received by the wireless communication module. In this or other similar manners, the input unit 50 may receive an input identifying a wind mode from a user and may provide information associated with the received input to the controller 60.

The controller 60 may set a position of the fan housing 400 of the dryer 1 based on the received input (S200). In detail, the controller 60 may set the position of the fan housing 400 of the dryer 1, that is, a degree by which the fan housing 400 is moved in forward and/or backward directions based on the input of the wind mode provided from the input unit 50. In addition to the position of the fan housing 400, the controller 60 may also set other configuration setting, such as the air volume and static pressure of the blast fan 440 as based on the input of the wind mode. That is, the controller 60 may control a wind direction and air volume of wind generated by the blast fan 440 based on the input of the wind mode provided from the input unit 50. For example, the controller 60 may set the degree by which the fan housing 400 is moved in forward and/or backward directions within the housing guide 210 so as to control an air volume. In addition, the controller 60 may control the air volume in the same or differently way for each of the first to fourth wind modes. That is, the controller 60 may perform control functions such that similar air volume are generated in all of the four wind modes or, alternatively, may perform control to generate wind with different air volumes in respective wind modes. For reference, the setting of the air volume and static pressure of the blast fan 440 by the controller 60 may be performed before, after, or simultaneously with the setting of the position of the fan housing 400.

The controller 60 may set the position of the fan housing 400 (S200) and, then, may move the fan housing 400 to the set position (S300). In detail, the controller 60 may provide a command to a driver 70 for moving the fan housing 400 to the desired set position. The slide protrusion 405*b* may be formed at an outermost portion of the body portion 405 of the fan housing 400 and, thus, the fan housing 400 may be capable of being moved in forward and/or backward directions along the first slide hole 138 of the air guide 130 and the second slide hole 218 of the housing guide 210.

In one example, the controller 60 may control a motor (not shown) that moves the fan housing 400 within the passage formed by the air guide 130 and the housing guide 210. For example, the controller 60 may selectively activate the motor to move the fan housing 400 in the forward or backward directions until the fan housing 400 is positioned in a location in the passage associated with the selected wind mode, such as positioning the fan housing in a far forward position for the first wind mode and in a far backward position for the fourth wind mode.

When the fan housing 400 is moved to the set position (S300), the controller 60 may drive the blast fan 440 in the fan housing 400 (S400). In detail, the controller 60 may control the motor 430 in the fan housing 400 to drive the blast fan 440. The controller 60 may control an amount of electrical current and/or voltage provided to the motor 430 so as to control the rotation of the blast fan 440 to realize desired levels of air volume and static pressure associated with the selected wind mode.

The controller 60 may drive the ionizer 500 based on the selected wind mode associate with the received input. The driving of the ionizer 500 by the controller 60 may be performed after the driving of the blast fan 440 in response to the driving of the motor 430. In more detail, the controller 60 may drive the ionizer 500 upon receiving an input associated with a selection of the third wind mode.

As described above, according to the present disclosure, a user may select any one of the first to fourth wind modes as necessary and, accordingly, the wind direction and air volume of warm air may be changed in various ways. Accordingly, the dryer 1 according to the present disclosure may satisfy user requirements for selecting various wind modes and may also prevent the user skin from being excessively dried and damaged or a bathroom space from being dried by less than an expected degree.

According to the present disclosure, the dryer 1 may effectively remove germs and virus by the ionizer 500 while a bathroom space is dried and, thus, it is not required for a user to purchase a separate apparatus for removing germs and virus in a bathroom or to directly perform sterilization treatment. Accordingly, the dryer 1 according to the present disclosure may overcome an issue in terms of costs for purchasing the separate apparatus and may also reduce a burden of sterilization treatment of the user.

According to the present disclosure, the fan housing 400 may be moved in forward and/or backward directions along the air guide 130 and the housing guide 210 and, thus, a wind direction may be changed in various ways, an air pressure may not be affected, and noise may be prevented from being generated. In addition, the dryer 1 according to the present disclosure may be configured in such a way that a direction wing is not installed at an outlet, thereby overcoming an issue in that a rotation portion of a direction wing is damaged or lost, and would need to be replaced by the user.

In addition, according to the present disclosure, when the fan housing 400 is moved in forward and/or backward directions, the fan housing 400 may be hidden by the air guide 130 and the housing guide 210 and movement of the fan housing 400 may not be externally viewable by the user, thereby satisfying user preference for maintaining a bathroom in a static and silent state. In addition, the dryer 1 according to the present disclosure may not separately rotate an outlet for change in wind direction, thereby overcoming an issue in that a rotation portion of the outlet may be damaged and lost and may need to be replaced.

According to the present disclosure, a user may select various wind modes and, accordingly, the wind direction and air volume of warm air may be changed in various ways. Accordingly, dryer of the present disclosure may satisfy user requirements for selecting various wind modes and may also prevent the user skin from being excessively dried to be damaged or a bathroom space from being dried by an expected degree or less.

The present disclosure may remove germs and virus by an ionizer while a bathroom space is dried and, thus, it is not required for a user to purchase a separate apparatus for removing germs and virus in a bathroom or to directly perform sterilization treatment. Accordingly, the present disclosure may overcome an issue in terms of costs for purchasing the separate apparatus and may also reduce a burden of sterilization treatment of the user.

According to the present disclosure, a wind direction may be changed in various ways without installation of a plurality of direction wings at an outlet and, thus, a wind pressure may not be affected, and noise may be prevented from being generated. In addition, according to the present disclosure, a direction wing may not be installed at an outlet, thereby overcoming an issue in that a rotation portion of a direction wing is damaged and cost for replacing components is consumed due to the damage of the rotation portion of the direction wing.

In addition, according to the present disclosure, a wind direction may be changed by moving the fan housing in forward and backward directions, and the forward and backward movement of the fan housing may be hidden and may not be externally captured by the eyes. Accordingly, the present disclosure may satisfy user preference for maintaining a bathroom in a static and silent state. In addition, the present disclosure may not separately rotate an outlet for change in wind direction, thereby overcoming an issue in that a rotation portion of the outlet is damaged and cost for replacing components is consumed due to the damage of the rotation portion of the outlet.

It is an aspect of the present disclosure to provide a dryer and a method for controlling the same, for preventing the user skin from being excessively dried and damaged or a bathroom space from being dried by less than an expected degree via operations in various air flow modes according to user necessity. It is an aspect of the present disclosure to provide a dryer and a method for controlling the same, for removing germs and virus by an ionizer while drying a bathroom space without user purchase of a separate apparatus for removing germs or virus or direct sterilization treatment. It is another aspect of the present disclosure to provide a dryer and a method for controlling the same, for preventing noise from being generated without influencing wind pressure when changing a wind direction by a rotatable direction wings at an outlet. It is an yet another aspect of the present disclosure to provide a dryer and a method for controlling the same, for satisfying user preference for maintaining a bathroom in a static and silent state by moving a fan housing in forward and backward directions along a housing guide without rotation movement of an outlet while a wind direction is changed.

Aspect of the present disclosure are not limited to the above-described aspects, and other aspects can be appreciated by those skilled in the art from the following descriptions. Further, it will be easily appreciated that the objects and advantages of the present disclosure can be practiced by means recited in the appended claims and a combination thereof.

As described above, conventionally, there is a problem in that it is difficult to operate such a conventional structure in various modes according to user requirements while a bathroom space or a user body is dried. In accordance with one aspect of the present disclosure, a dryer includes a controller configured to control forward and backward movement of a fan housing and an air volume and a static pressure of a blast fan. That is, according to the present disclosure, the controller may receive an input of a wind mode desired by a user through an input unit and control a wind direction and air volume of wind generated by the blast fan. Thereby, the dryer may be operated in various modes according to user requirements, thereby preventing the user skin from being excessively dried to be damaged or a bathroom space from being dried by an expected degree or less.

As described above, conventionally, there is a problem in that a conventional dryer is capable of simply drying a bathroom space or a user body but is not capable of removing germs or virus in the bathroom. In accordance with one aspect of the present disclosure, the dryer includes an ionizer provided at one side of an internal space formed between the front case and the rear case. The front case includes an ion outlet at a portion that overlaps the ionizer. That is, according to the present disclosure, the ionizer is also driven while drying the bathroom space. Accordingly, germs and virus may also be removed by the ionizer while drying a bathroom space without user purchase of a separate apparatus for removing germs or virus or direct sterilization treatment.

As described above, conventionally, there is a problem in that a plurality of direction wings are installed at an outlet to change a wind direction and, thus, a wind pressure is affected and noise is also generated. In accordance with one aspect of the present disclosure, a direction of wind ejected from a heater is changed by moving a fan housing in forward and backward directions. That is, the present disclosure, depending on a relative position between the air guide of the front case and a proceeding path of the wind ejected from the heater, the wind direction may be changed in various ways. Thereby, the issue in terms of noise may be prevented without influence on a wind pressure while the wind direction is changed.

As described above, conventionally, when a wind direction is changed, an outlet is rotated and, thus, there is a problem in that user preference for maintaining a bathroom in a static and silent state is not satisfied. In accordance with one aspect of the present disclosure, a fan housing is moved in forward and backward directions along an air guide and a housing guide without rotation of an outlet when a wind direction is changed. That is, according to the present disclosure, when the fan housing is moved in forward and backward directions, the forward and backward movement of the fan housing may be hidden and may not be externally captured by the eyes, thereby satisfying user preference for maintaining a bathroom in a static and silent state.

In one implementation, a dryer comprises: a front case including: a first opening, and an air guide positioned around the first opening and protruding forward from the front case; a rear case coupled to the front case and including: a second opening, the second opening overlapping the first opening, and a housing guide positioned around the second opening and protruding backward from the rear case; a fan housing enclosing a fan and being received in a passage defined by the air guide and the housing guide; and a heater coupled to the fan housing, the heater being configured to receive an air flow generated by the fan, to heat the air flow, and to output the heated air flow, wherein a direction of the heated air flow outputted from the heater is changed depending on a movement of the fan housing within the passage.

In another embodiment, a method of controlling a dryer comprised: receiving an input identifying one of a plurality of air flow modes; identifying one of a plurality of positions for a fan housing within the dryer based on the identified air flow mode; moving the fan housing to the identified position within the dryer; and driving a fan provided in the fan housing to generate a heated air flow associated with the identified air flow mode.

In another embodiment, a dryer comprises: a case including: an air guide protruding forward from the case, and a housing guide protruding backward from the case; a fan housing enclosing a fan, the fan housing being received in a passage defined by the air guide and the housing guide; and a heater coupled to the fan housing, the heater being configured to receive an air flow generated by the fan, to heat the air flow, and to output the heated air flow, wherein, when the fan housing is moved in the passage to a first location such that a proceeding path of the heated air flow outputted from the heater does not intersect an inner surface of a distal end of the air guide, the heated air flow continues along the proceeding path in one or more diagonal directions, and wherein, when the fan housing is moved in the passage to a second location such that the proceeding path of the heated air flow outputted from the heater intersects the interior surface of the air guide, the interior surface of the air guide redirects the heated air flow from the one or more diagonal directions associated with the proceeding path to a forward axial direction associated with the air guide.

The present disclosure described above may be variously substituted, altered, and modified by those skilled in the art to which the present disclosure pertains without departing from the scope and sprit of the present disclosure. Therefore, the present disclosure is not limited to the above-mentioned exemplary embodiments and the accompanying drawings Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dryer comprising:

a front case including:

a first opening, and an air guide positioned around the first opening and protruding forward from the front case;

a rear case coupled to the front case and including:

a second opening, the second opening overlapping the first opening, and a housing guide positioned around the second opening and protruding backward from the rear case, wherein an internal space is formed between the front case and the rear case;

a plurality of exhaust holes formed on the front case around the first opening; a blocking projection in the internal space, the blocking projection connecting the front case and the rear case and being positioned farther from the air guide than the plurality of exhaust holes, wherein when a proceeding path of heated air flow outputted from the heater overlaps the internal space, the heated air flow outputted from the heater is directed into the internal space and is discharged from the front case through the plurality of exhaust holes;

a fan housing enclosing a fan and being received in a passage defined by the air guide and the housing guide; and a heater coupled to the fan housing, the heater being configured to receive an air flow generated by the fan, to heat the air flow, and to output the heated air flow, wherein a direction of the heated air flow outputted from the heater is changed depending on a movement of the fan housing within the passage.

2. The dryer of claim 1, further comprising:

an input device configured to receive a user input and to forward information associated with the user input; and a controller configured to:

receive the information associate with the user input from the input device, and control one or more of the movement of the fan housing within the passage or a rotational speed of the fan based on the received information associated with the user input.

3. The dryer of claim 1, wherein, when the fan housing is moved in the passage such that a proceeding path of the heated air flow outputted from the heater does not intersect an inner surface of the air guide, the heated air flow continues along the proceeding path in one or more diagonal directions.

4. The dryer of claim 1, wherein, when the fan housing is moved in the passage such that a proceeding path of the heated air flow outputted from the heater intersects an interior surface of the air guide, the interior surface of the air guide redirects the heated air flow from a direction associated with the proceeding path to a forward axial direction associated with the air guide.

5. The dyer of claim 1, further comprising a cover formed on the fan housing and configured to cover the heater, wherein the cover includes an outlet through which the heated air flow outputted from the heater passes.

6. The dyer of claim 1, further comprising an ionizer provided at one side of an internal space formed between the front case and the rear case, wherein the one side of the internal space is positioned farther from the housing guide than another side of the internal space.

7. The dyer of claim 6, wherein the front case further includes an ion outlet at a region of the front case that overlaps the ionizer; and wherein the ionizer externally discharges ions through the ion outlet.

8. The dryer of claim 6, wherein the air guide includes an exhaust vent formed in an end of the air guide that is proximate to a front surface of the front case.

9. The dyer of claim 8, wherein, when a proceeding path of the heated air flow outputted from the heater intersects the exhaust vent, the heated air flow passes through the exhaust vent, moves along the front surface of the front case, and receives the ions discharged from the ionizer.

10. A method of controlling a dryer, the method comprising:

providing a dryer comprising:

a front case including:

a first opening, and an air guide positioned around the first opening and protruding forward from the front case;

a rear case coupled to the front case and including:

a second opening, the second opening overlapping the first opening, and a housing guide positioned around the second opening and protruding backward from the rear case, wherein an internal space is formed between the front case and the rear case;

a plurality of exhaust holes formed on the front case around the first opening; a blocking projection in the internal space, the blocking projection connecting the front case and the rear case and being positioned farther from the air guide than the plurality of exhaust holes, wherein when a proceeding path of heated air flow outputted from the heater overlaps the internal space, the heated air flow outputted from the heater is directed into the internal space and is discharged from the front case through the plurality of exhaust holes;

a fan housing enclosing a fan and being received in a passage defined by the air guide and the housing guide; and a heater coupled to the fan housing, the heater being configured to receive an air flow generated by the fan, to heat the air flow, and to output the heated air flow, wherein a direction of the heated air flow outputted from the heater is changed depending on a movement of the fan housing within the passage;

receiving an input identifying one of a plurality of air flow modes;

identifying one of a plurality of positions for a fan housing within the dryer based on the identified air flow mode;

moving the fan housing to the identified position within the dryer; and driving a fan provided in the fan housing to generate a heated air flow associated with the identified air flow mode.

11. The method of claim 10, further comprising identifying one or more of an air volume or a static pressure for the heated air flow associated with the identified air flow mode, wherein the position for the fan housing is further determined based on the identified one or more of the air volume or the static pressure for the heated air flow associated with the identified air flow mode.

12. The method of claim 10, further comprising selectively driving an ionizer to output ions into the heated air flow based on the received input, wherein the ionizer is driven to output the ions when moving the fan housing to the identified position within the dryer causes a proceeding path of the heated air flow to intersects the outputted ions.

13. A dryer comprising:

a case formed from a front case and a rear case and including:

an air guide protruding forward from the case, and a housing guide protruding backward from the case;

a fan housing enclosing a fan, the fan housing being received in a passage defined by the air guide and the housing guide, wherein the case includes a front case from which the air guide protrudes, and a rear case from the which the casing guide protrudes, an internal space is formed between the front case and the rear case, and a plurality of exhaust holes formed on the front case around the air guide; and a heater coupled to the fan housing, the heater being configured to receive an air flow generated by the fan, to heat the air flow, and to output the heated air flow, wherein, when the fan housing is moved in the passage to a first location such that a proceeding path of the heated air flow outputted from the heater does not intersect an inner surface of a distal end of the air guide, the heated air flow continues along the proceeding path in one or more diagonal directions, and wherein, when the fan housing is moved in the passage to a second location such that the proceeding path of the heated air flow outputted from the heater intersects the interior surface of the air guide, the interior surface of the air guide redirects the heated air flow from the one or more diagonal directions associated with the proceeding path to a forward axial direction associated with the air guide.

14. The dryer of claim 13, wherein, when the fan housing is moved in the passage to a third location such that the proceeding path of heated air flow outputted from the heater overlaps the internal space, the heated air flow outputted from the heater is directed into the internal space and is discharged from the front case through the plurality of exhaust holes.

15. The dryer of claim 13, further comprising:

an exhaust vent formed in an end of the air guide that is proximate to a front surface of the case, wherein, when the fan housing is moved in the passage to a fourth location such that the proceeding path of the heated air flow outputted from the heater intersects the exhaust vent, the heated air flow passes through the exhaust vent and moves along the front surface of the case.

16. The dryer of claim 15, further comprising an ionizer positioned to discharge ions into the heated air flow when the fan housing is moved to the fourth location in the passage.

17. The dryer of claim 13, wherein, when the fan housing is moved in the passage between the first location and the second location, a first portion of the heated air flow outputted from the heater continues along the proceeding path in the one or more diagonal directions, and the interior surface of the air guide redirects a second portion of the heated air flow from the one or more diagonal directions associated with the proceeding path to the forward axial direction associated with the air guide.

* * * * *